US011074843B2

(12) United States Patent
Numano et al.

(10) Patent No.: US 11,074,843 B2
(45) Date of Patent: Jul. 27, 2021

(54) DRIVE CIRCUIT, ELECTRO-OPTICAL DEVICE, ELECTRONIC APPARATUS INCLUDING ELECTRO-OPTICAL DEVICE, AND MOVABLE BODY INCLUDING ELECTRONIC APPARATUS

(71) Applicant: SEIKO EPSON CORPORATION, Tokyo (JP)

(72) Inventors: Gaku Numano, Chino (JP); Taro Hara, Chino (JP); Norichika Muraki, Hara-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/827,999

(22) Filed: Mar. 24, 2020

(65) Prior Publication Data

US 2020/0312212 A1 Oct. 1, 2020

(30) Foreign Application Priority Data

Mar. 25, 2019 (JP) ..... JP2019-055966

(51) Int. Cl.
*G09G 3/20* (2006.01)
*G09G 3/00* (2006.01)

(52) U.S. Cl.
CPC ..... *G09G 3/20* (2013.01); *G09G 3/006* (2013.01)

(58) Field of Classification Search
CPC ..... G09G 3/001; G09G 3/006; G09G 3/20; G09G 3/2096; G09G 3/3611; G09G 3/3648; G09G 3/3688; G09G 2310/08; G09G 2330/12; G09G 2380/10
See application file for complete search history.

(56) References Cited

U.S. PATENT DOCUMENTS

| | | | | |
|---|---|---|---|---|
| 9,461,774 | B2 | 10/2016 | Saito | |
| 2015/0026506 | A1* | 1/2015 | Lee | G06F 11/0751 714/3 |
| 2015/0220383 | A1* | 8/2015 | Saito | H04N 19/89 714/747 |
| 2017/0277586 | A1 | 9/2017 | Ito et al. | |
| 2017/0278441 | A1* | 9/2017 | Ooki | G09G 3/3648 |
| 2018/0190171 | A1* | 7/2018 | Tashiro | G09G 3/20 |

(Continued)

FOREIGN PATENT DOCUMENTS

| | | | |
|---|---|---|---|
| JP | 4926422 | B2 | 5/2012 |
| JP | 2017-183352 | A | 10/2017 |
| JP | 5325263 | B2 | 5/2018 |

*Primary Examiner* — Dmitriy Bolotin
(74) *Attorney, Agent, or Firm* — Oliff PLC

(57) ABSTRACT

A drive circuit 1000 is provided with an input terminal and an output terminal configured to be coupled to an external device 2000; a drive signal generation circuit 400 configured to use a synchronizing signal that is input from the external device 2000 via the input terminal to perform signal generation processing to generate a drive signal that drives an electro-optical panel 10; a state signal generation circuit 510 configured to generate a state signal indicating an operating state of the drive signal generation circuit 400; a return signal generation circuit 520 configured to generate a return signal obtained by superimposing the state signal on the synchronizing signal; and the output circuit 2000 configured to output the return signal from output terminals 581 and 582 to the external device 2000.

10 Claims, 7 Drawing Sheets

(56) References Cited

U.S. PATENT DOCUMENTS

| | | | | |
|---|---|---|---|---|
| 2018/0240397 | A1* | 8/2018 | Hara | G06F 3/048 |
| 2020/0020265 | A1* | 1/2020 | Lee | G09G 5/008 |
| 2020/0202818 | A1* | 6/2020 | Kuroiwa | G09G 5/393 |
| 2021/0091701 | A1* | 3/2021 | Baeurle | H02P 27/085 |

* cited by examiner

DRIVE CIRCUIT, ELECTRO-OPTICAL DEVICE, ELECTRONIC APPARATUS INCLUDING ELECTRO-OPTICAL DEVICE, AND MOVABLE BODY INCLUDING ELECTRONIC APPARATUS

The present application is based on, and claims priority from JP Application Serial Number 2019-055966, filed Mar. 25, 2019, the disclosure of which is hereby incorporated by reference herein in its entirety.

BACKGROUND

1. Technical Field

This invention relates to a drive circuit of an electro-optical device.

2. Related Art

Electro-optical devices have been applied to a wide range of uses, including automotive uses, which has led to stricter safety demands. JP-A-1-2017-183352 discloses a technique in which a driver circuit unit of a display device is provided with an abnormality determination unit.

JP-A-1-2017-183352 is an example of the related art.

However, if a driver circuit unit of a display device is provided with an abnormality determination unit, it is necessary to also provide a terminal and a signal line for transmitting a control signal and the like between the driver circuit unit and an external device that controls the driver circuit unit, as well as provide a signal line for transmitting an abnormality determination signal.

SUMMARY

A drive circuit according to one mode of the present disclosure drives an electro-optical panel, including: an input terminal and an output terminal configured to be coupled to an external device; a drive signal generation circuit configured to use a synchronizing signal that is input from the external device via the input terminal to generate a drive signal that drives the electro-optical panel; a state signal generation circuit configured to generate a state signal indicating an operating state of the drive signal generation circuit; a return signal generation circuit configured to generate a return signal obtained by superimposing the state signal on the synchronizing signal; and an output circuit configured to output the return signal from the output terminal to the external device.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
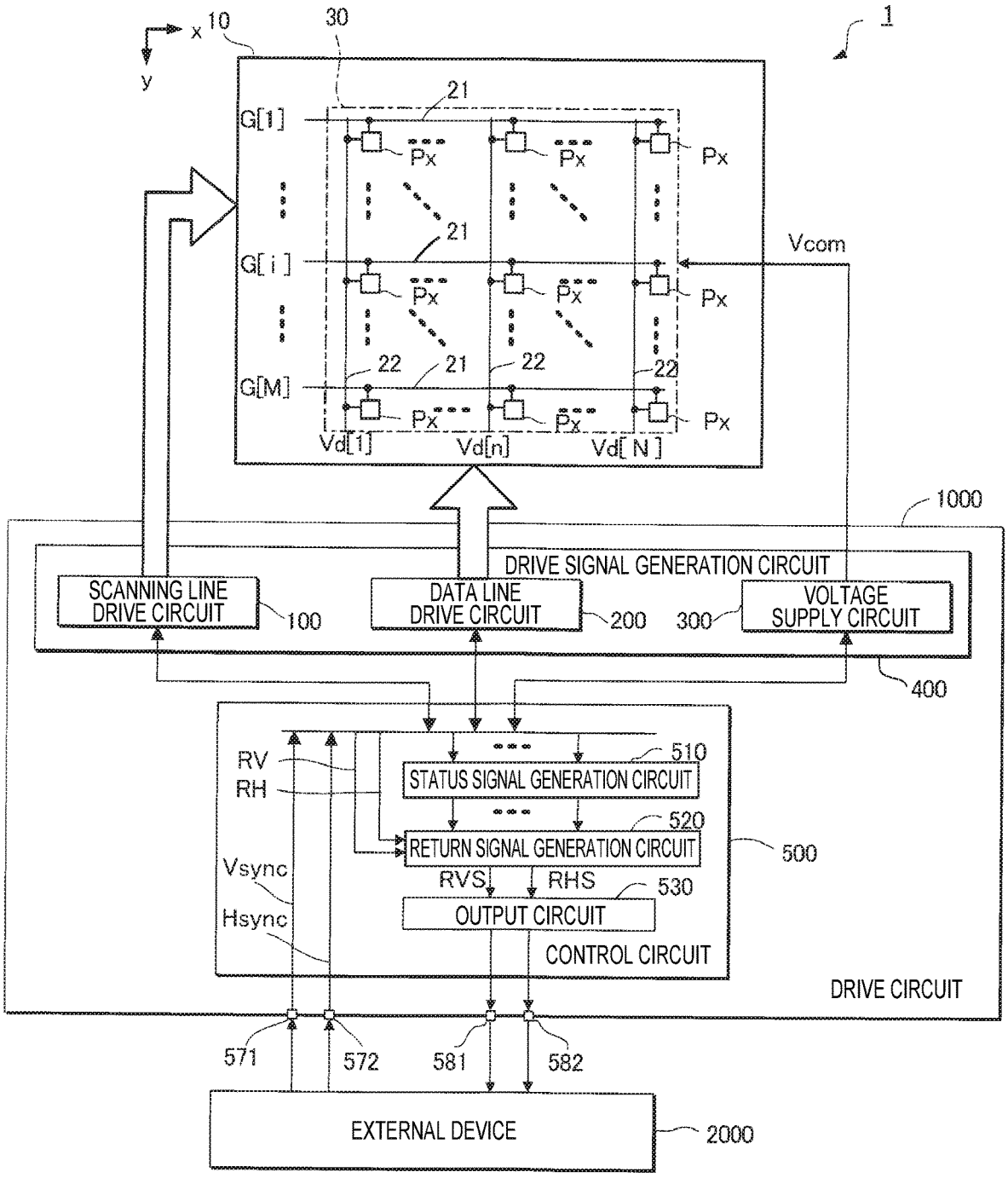
FIG. 1 is a block diagram showing a configuration of an electro-optical device that includes a drive circuit that is a first embodiment.

The following are descriptions of embodiments with reference to the drawings. However, the sizes and scale of the components shown in the drawings are differentiated from the sizes and scale of the actual components as appropriate. Also, the embodiments in the following description are subject to various technically desirable limitations, but the embodiments are not limited thereto.

A. First Embodiment

FIG. 1 is a block diagram of an electro-optical device 1 that includes a drive circuit 1000 that is a first embodiment. The electro-optical device 1 includes an electro-optical panel 10, the drive circuit 1000 that drives the electro-optical panel 10, and an external device 2000 that controls the drive circuit 1000. In the example described below, the external device 2000 functions as both a host device that supplies image data to the drive circuit 1000, and as a control device that supplies control signals to the drive circuit 1000. However, the external device 2000 may also be a device that only functions as a host device, or only functions as a control device. The electro-optical device 1 is a device that uses an electro-optical material of which the optical characteristics thereof are changed by electrical energy. Examples of the electro-optical material include liquid crystal, organic electroluminescent material, and a charged substance that is used in an electrophoresis element. The present embodiment describes an electro-optical panel that uses liquid crystal as the electro-optical material.

In the electro-optical panel 10, the axis along which scanning lines 21 run is the x-axis, and the axis that is orthogonal to the x-axis is the y-axis. M 1st to M-th rows of the scanning lines 21 extending along the x-axis are formed, and N 1st to N-th columns of data lines 22 extending along the y-axis are formed. Note that M and N are natural numbers. The first row of the scanning lines 21 is an example of a first scanning line, and the second row of the scanning lines 21 is an example of a second scanning line. Also, the first column of data lines 22 is an example of a first data line, and the second column of data lines 22 is an example of a second data line. In the electro-optical panel 10, pixel circuits Px are arranged in a matrix of the M rows vertically and N columns horizontally, at positions where the scanning lines 21 and the data lines 22 intersect with each other.

As shown in FIG. 1, the drive circuit 1000 includes a drive signal generation circuit 400 and a control circuit 500. The drive circuit 1000 also includes input terminals 571 and 572 and output terminals 581 and 582, all of which are coupled to the external device 2000 via signal lines.

Input image data and control signals are supplied from the external device 2000 to the drive circuit 1000. Here, the input image data includes data for regulating a tone to be displayed by the pixel circuits Px. For example, the input image data may be 8-bit digital data for regulating a tone to be displayed by the pixels. Also, the control signals include synchronizing signals such as a vertical synchronizing signal Vsync and a horizontal synchronizing signal Hsync. The vertical synchronizing signal Vsync of these control signals is input into the control circuit 500 via the input terminal 571, and the horizontal synchronizing signal Hsync is input into the control circuit 500 via the input terminal 572.

Here, the vertical synchronizing signal Vsync is a synchronizing signal for instructing the start of a vertical scanning period, and is a vertical start pulse signal that includes one pulse at the start of the vertical scanning period. Also, the horizontal synchronizing signal Hsync is a synchronizing signal for instructing the start of a horizontal scanning period, and is a horizontal start pulse signal that includes one pulse at the start of the horizontal scanning period. In the following description, one instance of vertical scanning is called one vertical scan, and the time needed for one vertical scan is called one vertical scanning period. Also, one instance of horizontal scanning is called one horizontal scan, and the time needed for one horizontal scan is called one horizontal scanning period.

The control circuit 500, based on synchronizing signals supplied from the external device 2000, generates various types of control signal to control the drive signal generation circuit 400. Also, the control circuit 500, based on input image data supplied from the external device 2000, generates display image data that indicates an image to be displayed on the electro-optical panel 10, and outputs the display image data to the drive signal generation circuit 400.

The drive signal generation circuit 400 is a circuit that performs signal generation processing to generate drive signals for driving the electro-optical panel 10. The drive signal generation circuit 400 includes a scanning line drive circuit 100, a data line drive circuit 200, and a voltage supply circuit 300. The control circuit 500 receives the vertical synchronizing signal Vsync and the horizontal synchronizing signal Hsync via the input terminals 571 and 572, and supplies the synchronizing signals to the scanning line drive circuit 100. The control circuit 500 also supplies the vertical synchronizing signal Vsync and the horizontal synchronizing signal Hsync to the data line drive circuit 200. Whenever the scanning line drive circuit 100 is given a vertical synchronizing signal Vsync, the scanning line drive circuit 100 sequentially selects the M scanning lines 21 in synchronization with the horizontal synchronizing signal Hsync, and sets a scanning signal for the selected scanning lines 21 to an active level. Whenever the data line drive circuit 200 is given a horizontal synchronizing signal Hsync, the data line drive circuit 200 sequentially receives N pixels worth of image data Dp from the control circuit 500, and repeatedly outputs N pixels worth of analog data signals that correspond to the N pixels worth of the image data Dp to the N data lines 22. The control circuit 500 also supplies return signals RVS and RHS from the output terminals 581 and 582 to the external device 2000. Note that the return signals RVS and RHS will be described later.

The scanning line drive circuit 100 is a circuit that performs signal generation processing to generate drive signals for driving the scanning lines 21 of the electro-optical panel 10. The data line drive circuit 200 is a circuit that performs signal generation processing to generate drive signals for driving the data lines 22 of the electro-optical panel 10. The voltage supply circuit 300 is a circuit that outputs various types of voltage as drive signals, such as a common voltage to a common electrode 30 of the electro-optical panel 10, a power source voltage to the scanning line drive circuit 100, and a power source voltage to the data line drive circuit 200.

Figure 2:
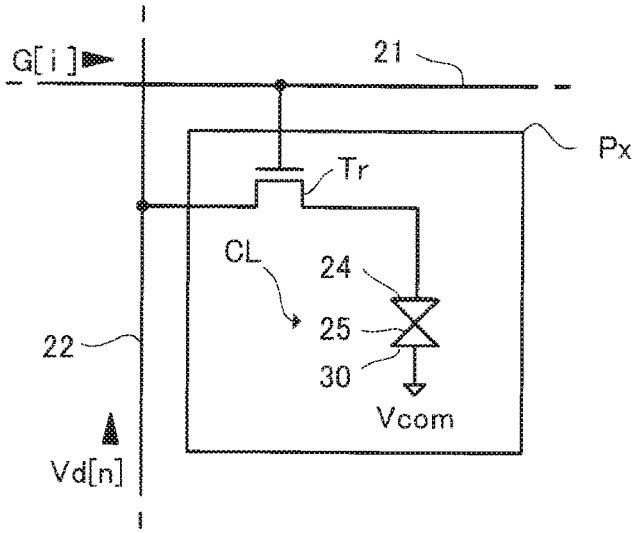
FIG. 2 is a diagram showing a configuration of a pixel circuit in the same embodiment.

FIG. 2 is a circuit diagram of the pixel circuits Px that are provided in the electro-optical panel 10. As shown in FIG. 2, each of the pixel circuits Px includes a liquid-crystal element CL and a write transistor Tr. The liquid-crystal element CL includes the common electrode 30, a pixel electrode 24, and liquid crystal 25 that is provided between the common electrode 30 and the pixel electrode 24. Here, the common electrode 30 faces the pixel electrodes 24 of all of the pixels on the electro-optical panel 10. A common voltage VCOM that is supplied from the voltage supply circuit 300 is applied to the common electrode 30. The transmittance of the liquid crystal 25 of the liquid crystal element CL changes depending on the voltage applied to the liquid crystal element CL, or more specifically the voltage applied between the common electrode 30 and the pixel electrode 24.

In the present embodiment, the write transistors Tr are N-channel transistors whose gates are coupled to the scanning lines 21, and are provided between the liquid-crystal elements CL and the data lines 22, and control the electrical coupling of both the scanning lines and the data lines. That is to say, the write transistors Tr perform control to electrically couple or decouple the liquid-crystal element CL and the data lines 22. If a scanning signal G[i], which is a drive signal, is set to an active level, the write transistors Tr of the pixel circuits Px on the i-th row simultaneously transition to an on-state. Note that i is a natural number from 1 to M.

At the timing at which the scanning lines 21 corresponding to the pixel circuits Px are selected and the write transistors Tr of those pixel circuits Px are turned on, a data signal Vd[n], which is a drive signal, is supplied from the data lines 22 to those pixel circuits Px. As a result, the liquid crystal 25 of those pixel circuits Px is set to a transmittance that depends on the data signal Vd[n], and therefore the pixels that correspond to the pixel circuits Px display a tone that depends on the data signal Vd[n].

Figure 3:
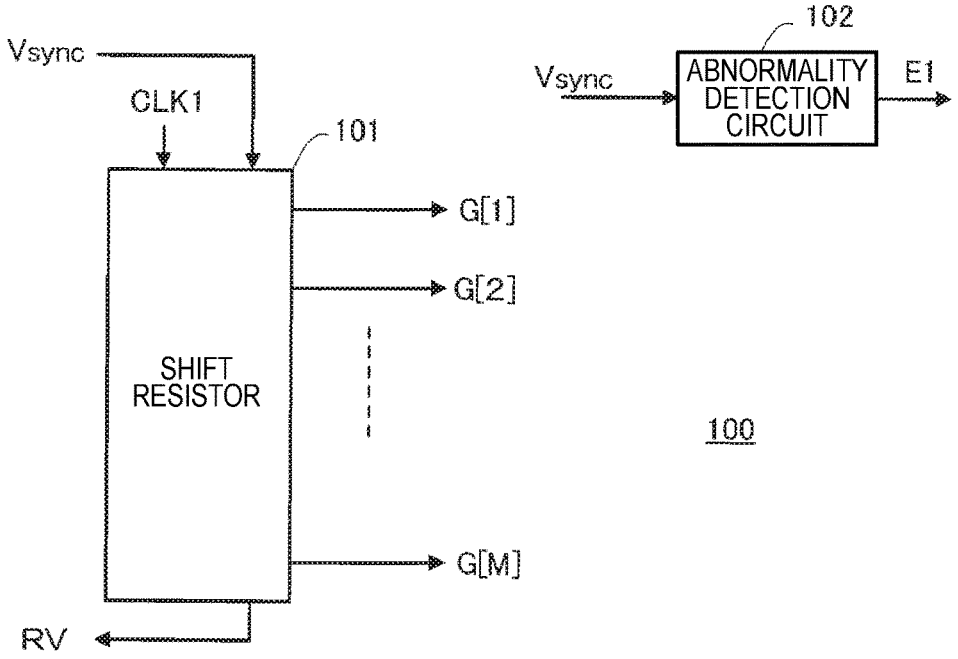
FIG. 3 is a block diagram showing a configuration of a scanning line drive circuit in the same embodiment.

FIG. 3 is a block diagram showing a configuration of the scanning line drive circuit 100. The scanning line drive circuit 100 includes a shift register 101. The shift register 101 has M stages corresponding to the M scanning lines 21, and shifts the vertical synchronizing signal Vsync, by a clock CLK1 that is synchronized with the horizontal synchronizing signal Hsync, and supplies the scanning signal G[i], which is a drive signal, from the respective stages to the scanning lines 21 of the electro-optical panel 10. Thus, the 1st to M-th scanning lines 21 are sequentially selected one-by-one every one horizontal scanning period H. More specifically, the scanning line drive circuit 100 selects the scanning line 21 of the i-th row by setting the scanning signal G[i] to an active level.

The pulse that is output from the final stage of the shift register 101 is supplied to the control circuit 500 as a return vertical synchronizing signal RV. In the scanning line drive circuit 100, the return vertical synchronizing signal RV indicates the end of signal generation processing for one vertical scanning period based on the vertical synchronizing signal Vsync. Note that the return vertical synchronizing signal RV is actually the pulse that is output from the final stage of the shift register 101, but will be referred to as the return vertical synchronizing signal RV for the convenience of naming.

The scanning line drive circuit 100 in the present embodiment includes an abnormality detection circuit 102. The abnormality detection circuit 102 monitors the vertical synchronizing signal Vsync and outputs an abnormality detection signal E1 if the pulse of the vertical synchronizing signal Vsync does not occur at the normal time. There are many conceivable states that would cause the abnormality detection signal E1 to be generated, and the abnormality detection signal E1 of the present embodiment is generated in states such as those described below.

TO is given as the normal cycle of the vertical synchronizing signal Vsync, and is given as a predetermined value. When the pulse of the vertical synchronizing signal Vsync appears, the abnormality detection circuit 102 sets a start time of TO− from when the pulse appears, and sets an end time of TO+ from when the pulse appears. If the next pulse of the vertical synchronizing signal Vsync does not appear in the period between the start time and the end time, the abnormality detection circuit 102 determines that there is an abnormality in the vertical synchronizing signal Vsync, and outputs the abnormality detection signal E1. It is sufficient to set the predetermined value as an allowable range of the scanning line drive circuit 100, based on the characteristics of the scanning line drive circuit 100 that operates in accordance with the vertical synchronizing signal Vsync.

Figure 4:
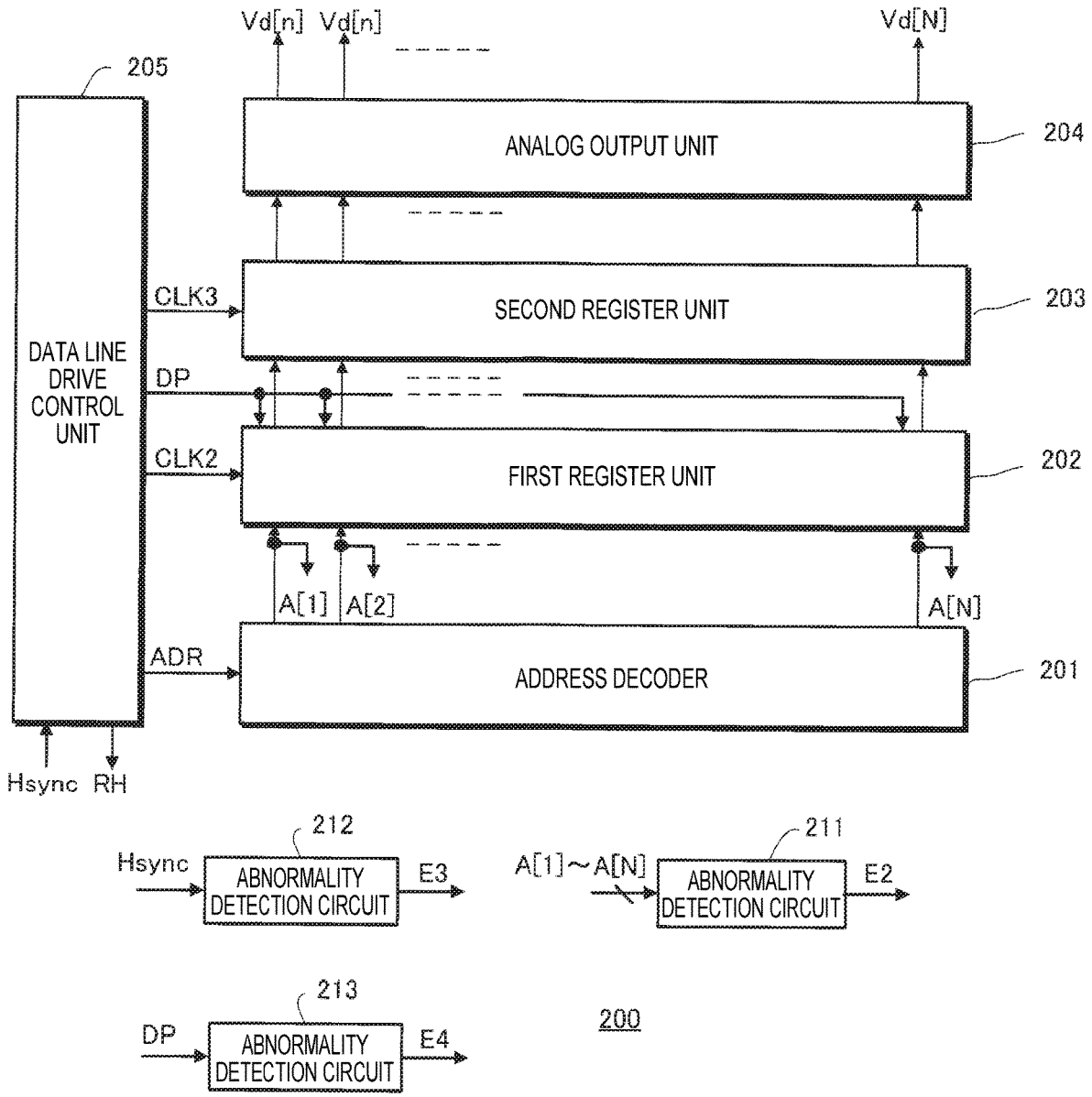
FIG. 4 is a block diagram showing a configuration of a data line drive circuit in the same embodiment.

FIG. 4 is a block diagram showing a configuration of the data line drive circuit 200. The data line drive circuit 200 includes a data line drive control unit 205, an address decoder 201, a first register unit 202, a second register unit 203, an analog output unit 204, and abnormality detection circuits 211 to 213. The data line drive control unit 205, in response to the horizontal synchronizing signal Hsync being input from the control circuit 500, repeatedly receives address data ADR, display image data DP, and clocks CLK2 and CLK3 from the control circuit 500 and supplies the received data and clocks to respective units of the data line drive circuit 200. The data line drive control unit 205 also outputs a return horizontal scanning signal RH in response to the horizontal synchronizing signal Hsync being input from the control circuit 500.

The first register unit 202 has N stages. The second register unit 203 also has N stages. The stages of the first register unit 202 and the second register unit 203 correspond to the pixels arranged along the x-axis.

One pixel worth of the display image data DP and the address data ADR is given to the data line drive circuit 200 in synchronization with the clock CLK2. The clock CLK2 and the display image data DP are supplied from the control circuit 500 to the data line drive control unit 205, and are output from the data line drive control unit 205 to the first register unit 202. Here, the address data ADR is data indicating the number n of the stage to be the writing destination of one pixel worth of display image data DP in the first register unit 202, and changes from 1 to N in one horizontal scanning period. The address decoder 201, based on address data ADR, outputs a write enable signal A[n] to the first register unit 202. Note that n is a natural number from 1 to N. Thus, the address decoder 201 sets only the write enable signal A[n] that corresponds to the number n indicating the address data ADR of the write enable signal A[n] to an active level, and sets the other write enable signals A[사 n] to an inactive level.

With the first register unit 202, the display image data DP that is supplied from the control circuit 500 via the data line drive control unit 205 is given to the data input terminal of each stage. Also, the write enable signal A[n] is given at the n-th stage. For this reason, in one horizontal scanning period, N pixels worth of display image data DP is sequentially written in the N stages of the first register unit 202.

The output data of the stages of the first register unit 202 is given to the data input terminals of the stages of the second register unit 203. The clock CLK3 is given to the clock input terminal of each stage of the second register unit 203. The clock CLK3 is a clock that is generated once each time writing of data to the N stages of the first register unit 202 has finished in each horizontal scanning period. The N pixels worth of display image data DP that is written in the N stages of the first register unit 202 is written in the N stages of the second register unit 203 by the clock CLK3.

The analog output unit 204 D/A coverts the N pixels worth of display image data stored in the N stages of the second register unit 203 for each pixel, and outputs the converted display image data as the previously-described data signal Vd[n]. Note that j is a natural number from 1 to N.

The data line drive circuit 200, in accordance with the horizontal synchronizing signal Hsync, ends signal generation processing that generates one horizontal scanning period worth of data signals, and supplies a return horizontal synchronizing signal RH to the control circuit 500. Note that the return horizontal synchronizing signal RH is actually the pulse that is output from the final stage of the data line drive circuit 200, but will be referred to as the return horizontal synchronizing signal RH for the convenience of naming.

The abnormality detection circuit 211 monitors whether or not the pulses of all the write enable signals A[j] have occurred in one horizontal scanning period, and outputs an abnormality detection signal E2 if the pulses of any of the write enable signals A[j] have not occurred.

The abnormality detection circuit 212 monitors whether or not the pulse of the horizontal synchronizing signal Hsync occurs at the normal timing, and outputs an abnormality detection signal E3 if the pulse does not occur at the normal timing. The method used to generate the abnormality detection signal E3 is similar to the method used to generate the abnormality detection signal E1 in relation to the vertical synchronizing signal Vsync.

In the present embodiment, the control circuit 500 generates error detection data from the display image data DP, and supplies the data line drive circuit 200 with display image data to which the error detection data has been added. The error detection data may be, for example, a CRC (Cyclic Redundancy Check) code.

The data line drive circuit 200 removes the error detection data from the display image data DP to which the error detection data has been added, and generates the above-described data signal Vd[n] from the display image data from which the error detection data has been removed. Also, the abnormality detection circuit 213 generates error detection data from the display image data from which error detection data has been removed, and compares the generated error detection data with the error detection data that has been added to the display image data. The abnormality detection circuit 213 performs error detection on the display image data through this comparison, and outputs an abnormality detection signal E4 if there is an error.

Although omitted from the drawings, the voltage supply circuit 300 also includes an abnormality detection circuit. This abnormality detection circuit monitors the power source voltage supplied to the scanning line drive circuit 100 by the voltage supply circuit 300, monitors the power source voltage supplied to the data line drive circuit 200 by the voltage supply circuit 300, and outputs an abnormality detection signal if it is detected that the power source voltages have exceeded a preset threshold value or are less than the threshold value.

As shown in FIG. 1, the control circuit 500 includes a state signal generation circuit 510, a return signal generation circuit 520, and an output circuit 530. The state signal generation circuit 510 monitors the operating state of the drive signal generation circuit 400, and generates a state signal that indicates the operating state of the drive signal generation circuit 400. Here, operating states include a normal state indicating that the drive signal generation circuit 400 is operating normally, and an abnormal state indicating that the drive signal generation circuit 400 is operating abnormally. In the present embodiment, the state signal generated by the state signal generation circuit 510 indicates the content of the abnormality of the abnormal state. Specifically, the state signal generation circuit 510 monitors the output signals of the abnormality detection circuits 102 and 211 to 213 and the like in the drive signal generation circuit 400, and, if an abnormality detection signal has been output, the state signal generation circuit 510 outputs that abnormality detection signal as a state signal. The return signal generation circuit 520 generates a return signal RVS, which is the return vertical synchronizing signal RV with the state signal superimposed thereon, and generates a return signal RHS, which is the return horizontal synchronizing signal RH with the state signal superimposed thereon. The output circuit 530 outputs the return signals RVS and RHS from the output terminals 581 and 582 to the external device 2000.

The external device 2000 detects that an abnormality has occurred in the drive signal generation circuit 400 based on the state signals that have been superimposed on the return signals RVS and RHS.

Figure 5:
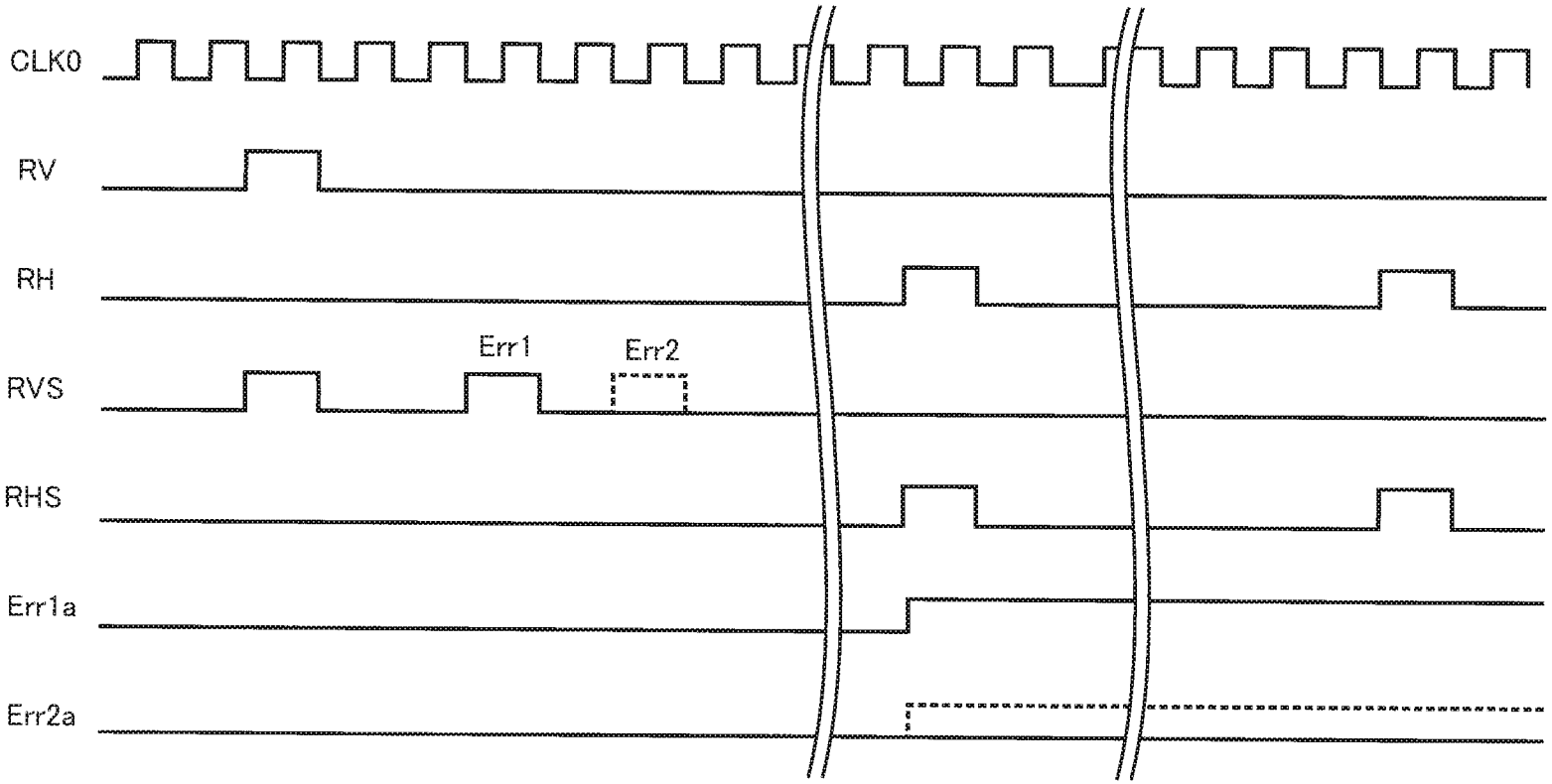
FIG. 5 is a time chart showing operations of the same embodiment.

FIG. 5 is a time chart showing operations of the present embodiment. In the present example, the return vertical synchronizing signal RV and the return horizontal synchronizing signal RH are imported in synchronization with a clock CLK0 that is generated in the control circuit 500, and the state signal is superimposed on the synchronizing signal.

With the present embodiment, the return signal generation circuit 520 generates the return signal RVS in which state signals Err1 and Err2 corresponding to the abnormality detection signals E1 and E2 are superimposed on the return vertical synchronizing signal RV.

Specifically, in the return signal RVS for example, after the timing of the falling edge of the pulse of the return vertical synchronizing signal RV, the period from the timing of the second falling edge to the timing of the third falling edge of the clock CLK0 is a 1-bit superimposable period. Once the state signal Err1 corresponding to the abnormality detection signal E1 is generated, the 1-bit superimposable period is set to an active level.

Also, in the return signal RVS, after the timing of the falling edge of the pulse of the return vertical synchronizing signal RV, the period from the timing of the fourth falling edge to the timing of the fifth falling edge of the clock CLK0 is also a 1-bit superimposable period. Once the state signal Err2 corresponding to the abnormality detection signal E2 is generated, the 1-bit superimposable period is set to an active level. Note that, although omitted from the drawings, a state signal indicating an abnormality in the drive signal generation circuit 400 is also superimposed on the return signal RHS.

With the return signals RVS and RHS, the period in which the state signal is superimposed is determined based on the type of state signal. Accordingly, the external device 2000 can differentiate between the different types of state signals based on, for example, the time difference between the timing at which the pulse occurs in the return signal RVS and the timing at which the state signal occurs. When the external device 2000 detects a state signal from the return signal RVS, the state signal will be reflected in the state signal inside the external device 2000 in the following horizontal scanning period. FIG. 5 shows an example of state signals Err1*a* and Err2*a* inside the external device 2000 that have had the state signals Err1 and Err2 reflected therein. The external device 2000 performs control such as outputting an alarm or stopping the operation of the electro-optical device 1, based on the state signals Err1*a* and Err2*a*.

In the present embodiment, it is also possible for the return signal generation circuit 520 to superimpose a normal detection signal, which detects that the drive signal generation circuit 400 is operating normally, on the return vertical synchronizing signal RV as a state signal and generate the return signal RVS. Also, in the present embodiment, if the abnormality detection signal serves as a state signal, then the state signal can indicate that the drive signal generation circuit 400 is operating normally when there is no abnormality detection signal. Similarly, if the normal detection signal serves as a state signal, then the state signal can indicate that the drive signal generation circuit 400 is operating abnormally when there is no normal detection signal.

As described above, the drive circuit 1000 according to the present embodiment includes the input terminal 571 and the output terminal 572 configured to be coupled to the external device 2000; the drive signal generation circuit 400 configured to use a synchronizing signal that is input from the external device 2000 via the input terminal 571 to perform signal generation processing to generate a drive signal that drives the electro-optical panel 10; the state signal generation circuit 510 configured to generate a state signal indicating an operating state of the drive signal generation circuit 400; the return signal generation circuit 520 configured to generate a return signal obtained by superimposing the state signal on the synchronizing signal; and the output circuit 2000 configured to output the return signal from the output terminals 581 and 582 to the external device 2000. Thus, the synchronizing signal and the state signal can be returned to the external device as a combined signal rather than being individually returned. Accordingly, the present embodiment will not lead to an increase in the number of signal wires or terminals of paths for coupling the drive circuit 1000 and the external device 2000 to each other, and makes it possible to supply the external device 2000 with a state signal indicating the state of the drive signal generation circuit 400.

Also, with the present embodiment, the return signal generation circuit 520 superimposes the state signal to generate a return signal in a period after a predetermined period of time has elapsed from the pulse of the synchronizing signal. Thus, it is possible to differentiate the timing at which the state signal is superimposed on the synchronizing signal depending on the type of state signal. Accordingly, by extracting a state signal that has been superimposed at a timing after a predetermined period of time has elapsed from the timing at which the pulse of a return signal has occurred, the external device 2000 can differentiate between the different types of abnormalities of the drive signal generation circuit 400 and can perform a suitable countermeasure.

Also, in the present embodiment, the operating states include a normal state indicating normal operation, and an abnormal state indicating an abnormal operation, and the state signal indicates the content of the abnormality of the abnormal state. Accordingly, the external device 2000 can detect an abnormal state of the drive signal generation circuit 400 from a return signal.

Also in the present embodiment, the drive signal generation circuit 400 is supplied with image data indicating an image to be displayed on the electro-optical panel 10, a power source voltage, and control signals used to generate drive signals, and the content of the abnormality of the abnormal state indicated by the state signal includes at least one of a transmission error in the image data, an abnormality in the power source voltage, and an abnormality in the control signal. Accordingly, the external device 2000 can suitably detect an important abnormal state in the electro-optical device 1.

Also in the present embodiment, the drive signal generation circuit 400 is supplied with image data indicating an image to be displayed on the electro-optical panel 10 and control signals used to generate drive signals, and the external device 2000 can function as a host device that generates image data or as a control device that generates control signals. Accordingly, with the present embodiment, the host device or the control device can detect the occurrence of an abnormality in the drive signal generation circuit 400.

In the present embodiment, the electro-optical panel 10 includes first and second scanning lines, the drive signal generation circuit 400 includes the scanning line drive circuit 100 that drives the first and second scanning lines, and the synchronizing signal is a vertical start pulse signal of which one is transmitted to the scanning line drive circuit 100 in one vertical scan. Accordingly, with the present embodiment, it is possible detect an abnormality that occurs in the scanning line drive circuit 100.

In the present embodiment, the electro-optical panel 10 includes first and second data lines, the drive signal generation circuit 400 includes the data line drive circuit 200 that drives the first and second data lines, and the synchronizing signal is a horizontal start pulse signal of which one is transmitted to the data line drive circuit 200 in one horizontal scan. Accordingly, with the present embodiment, it is possible to detect an abnormality that occurs in the data line drive circuit 200.

B. Second Embodiment

Figure 6:
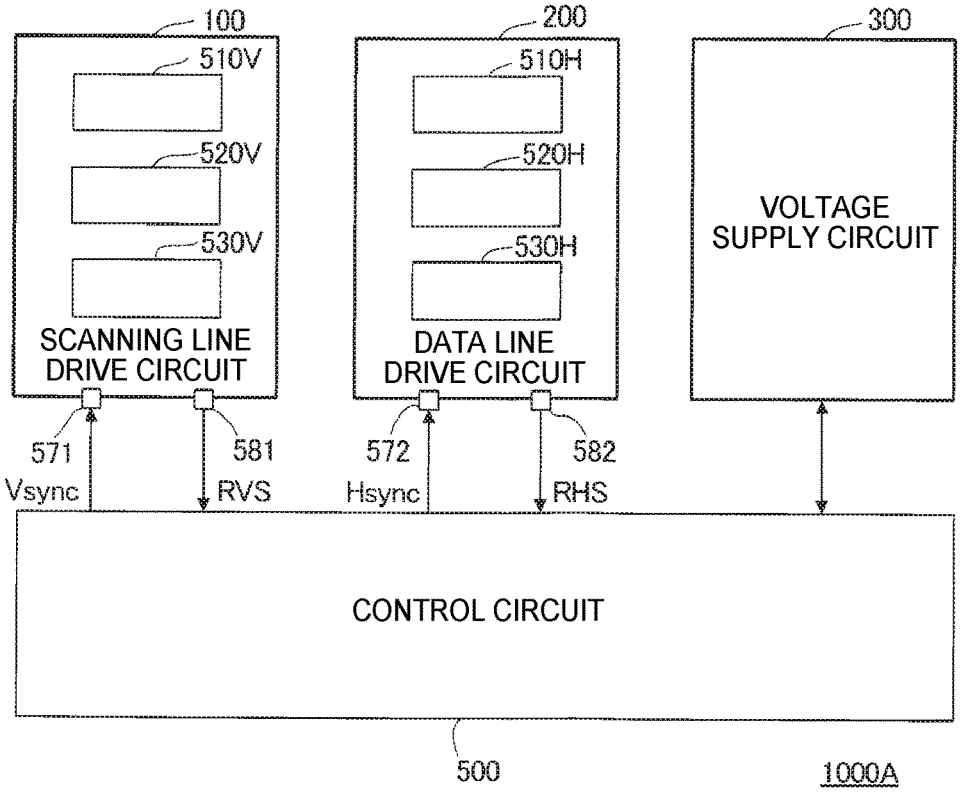
FIG. 6 is a block diagram showing a configuration of a drive circuit that is a second embodiment.

FIG. 6 is a block diagram showing a configuration of a drive circuit 1000A that is a second embodiment. With the first embodiment described above, the control circuit 500 is provided with the state signal generation circuit 510, the return signal generation circuit 520 and the output circuit 530. In contrast to this, in the present embodiment, the scanning line drive circuit 100 is provided with a state signal generation circuit 510V, a return signal generation circuit 520V, and an output circuit 530V, and the data line drive circuit 200 is provided with a state signal generation circuit 510H, a return signal generation circuit 520H, and an output circuit 530H.

In the scanning line drive circuit 100, a state signal indicating the state of the scanning line drive circuit 100 is generated by the state signal generation circuit 510V, the vertical synchronizing signal Vsync input from the control circuit 500 via the input terminal 571 is returned to the control circuit 500, and the return signal RVS, which is the return vertical synchronizing signal RV with the state signal superimposed thereon, is generated by the return signal generation circuit 520V. Thus, the return signal RVS is output from the output terminal 581 to the control circuit 500 by the output circuit 530V.

Also, in the data line drive circuit 200, the state signal indicating the state of the data line drive circuit 200 is generated by the state signal generation circuit 510H, the horizontal synchronizing signals Hsync input from the control circuit 500 via the input terminal 572 is returned to the control circuit 500, and the return signal RHS, which is the return horizontal synchronizing signal RH with a state signal superimposed thereon, is generated by the return signal generation circuit 520H. The return signal RHS is then output from the output terminal 582 to the control circuit 500 by the output circuit 530H.

The present embodiment will not lead to a marked increase in the number of signal wires or terminals of paths for coupling the control circuit 500 to the scanning line drive circuit 100 and the data line drive circuit 200, and makes it possible to supply the control circuit 500 with a state signal indicating the state of the scanning line drive circuit 100 and a state signal indicating the state of the data line drive circuit 200.

C. Other Embodiments

The first and second embodiments have been described above, but other embodiments are also possible. Examples of other embodiments are described below.

(1) With the embodiments described above, an abnormal state of the drive signal generation circuit 400 is detected and superimposed on synchronizing signals, but configurations are also possible in which specified operating states other than an abnormal state, such as a sleep-mode state, are detected and superimposed on return signals.

(2) For example, in the first embodiment described above, a selection signal that designates one of the scanning line drive circuit 100, the data line drive circuit 200, or the voltage supply circuit 300 is transmitted from the external device 2000 to the drive circuit 1000. The return signal generation circuit 520 selects the state signal indicating an abnormal state of the circuit that has been selected by the selection signal from the state signals generated by the state signal generation circuit 510, and superimposes the selection signal and the selected state signal on a synchronizing signal to generate a return signal. With this mode, even if there are many different types of state signals, it is possible to reduce the amount, or more specifically the number of bits, of state signals that are superimposed on a synchronizing signal at one time.

(3) In the above-described first embodiment for example, a configuration is also possible in which, when at least one state signal of the state signals generated by the state signal generation circuit 510 indicates an abnormal state, the state signal generation circuit 510 generates an identifying signal indicating whether or not that state signal is one of the state signal Err1, the state signal Err2, or the like, and the return signal generation circuit 520 superimposes the identifying signal on the synchronizing signal as a state signal. In this mode as well, it is possible to reduce the amount, or more specifically the number of bits, of state signals that are superimposed on a synchronizing signal at one time.

(4) In the embodiments described above, a liquid crystal display panel is used as the electro-optical panel 10, but embodiments are not limited thereto. The present disclosure can, for example, be applied to the electro-optical device 1 including an electro-optical panel 10 other than a liquid crystal display panel such as a display panel constituted by light emitting elements such as OLE Ds (Organic Light-Emitting Diodes) and a display panel constituted by electrophoresis elements. Note that in the embodiments described above, a configuration is described in which one external device 2000 is included, but a configuration is also possible in which the external device 2000 separately includes an output unit that outputs to the drive circuit 500 and an input unit for return signals from the drive circuit 500.

D. Example Applications

The electro-optical device 1 illustrated in the above modes can be used in various types of electronic apparatuses. FIGS. 7 to 10 illustrate specific modes of electronic apparatuses that have adopted the electro-optical device 1.

Figure 7:
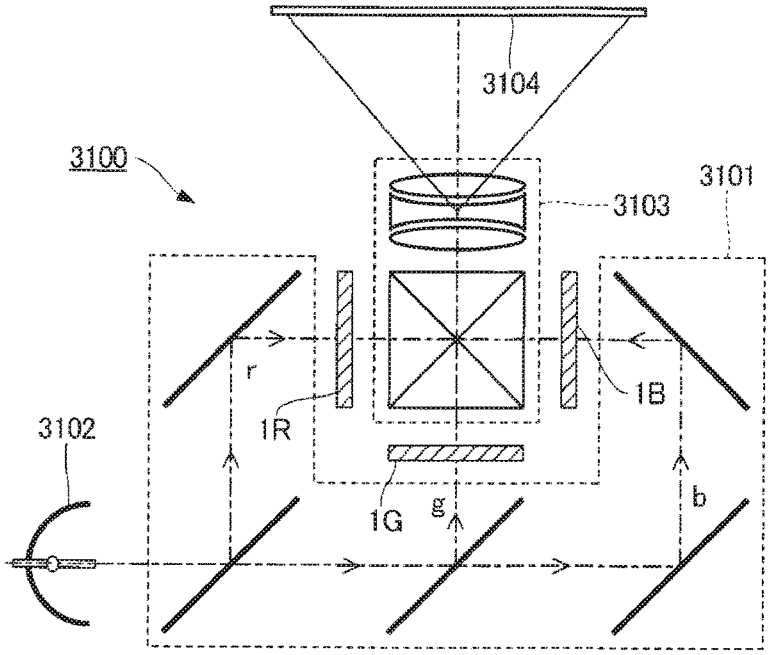
FIG. 7 is a schematic diagram of a projection-type display apparatus that is an example application.

FIG. 7 is a schematic diagram of a projection type display device 3100 to which electro-optical devices 1R, 1G, and 1B each having a similar configuration to the electro-optical device 1 are applied. The projection type display device 3100 includes three electro-optical devices 1R, 1G, and 1B corresponding to different display colors, specifically red, green, and blue. A lighting optical system 3101 supplies, of emitted light from a lighting device 3102, a red component r to the electro-optical device 1R, a green component g to the electro-optical device 1G, and a blue component b to the electro-optical device 1B. Each electro-optical device 1 functions as an optical modulator that modulates respective monochromatic light supplied from the lighting optical system 3101 according to a display image. The projection optical system 3103 combines the beams of light emitted from the respective electro-optical devices 1, and projects the combined light onto a projection surface 3104. An observer views the image projected on the projection surface 3104.

Figure 8:
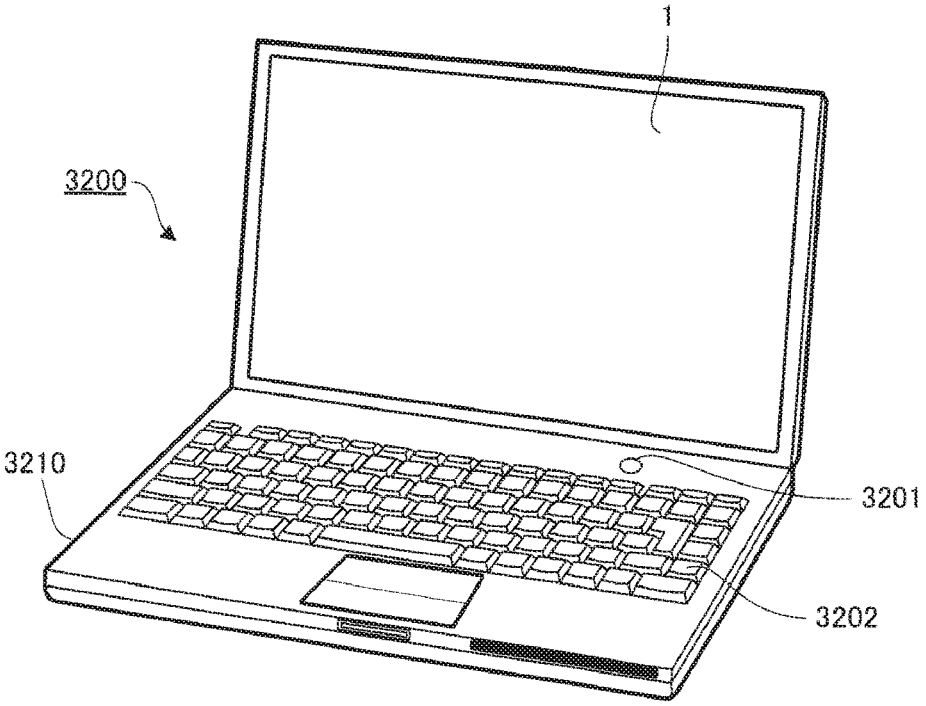
FIG. 8 is a schematic diagram of a personal computer that is an example application.

FIG. 8 is a perspective view of a portable personal computer 3200 that has adopted the electro-optical device 1. The personal computer 3200 includes the electro-optical device 1 that displays various types of images and a body portion 3210 in which a power switch 3201 and a keyboard 3202 are provided.

Figure 9:
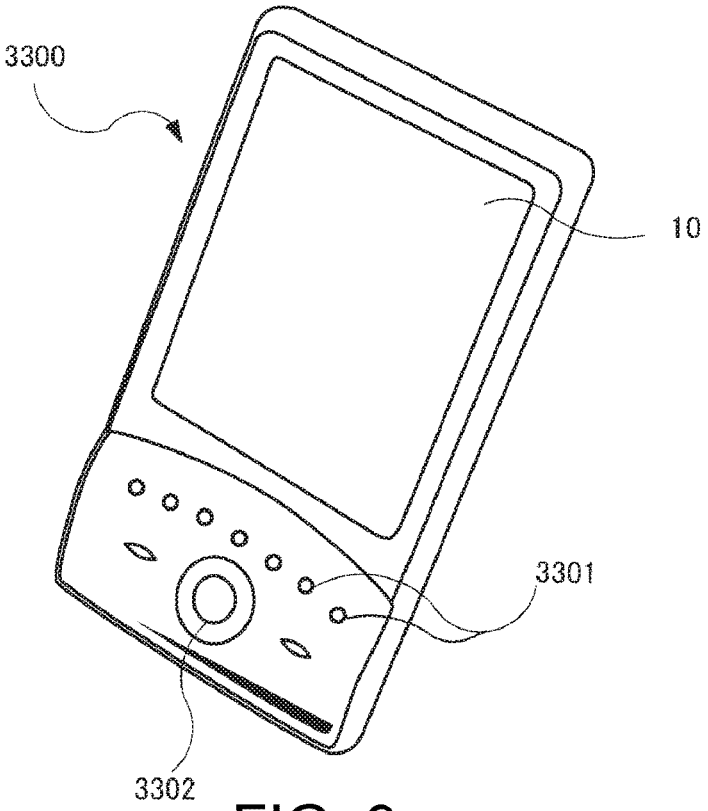
FIG. 9 is a schematic diagram of a mobile telephone that is an example application.

FIG. 9 is a diagram illustrating an exemplary configuration of a Personal Digital Assistant (PDA) to which the electro-optical device 1 has been applied. The information mobile terminal 3300 includes a plurality of operation buttons 3301, a power switch 3302, and the electro-optical device 1, which serves as a display unit. When the power switch 3302 is operated, various types of information such as an address book and a schedule book are displayed in the electro-optical device 1.

Electronic apparatuses to which the electro-optical device 1 can be applied include, other than the apparatuses illustrated in FIGS. 7 to 9, a Personal Digital Assistant (PDA), a digital still camera, a television, a video camera, an electronic organizer, electronic paper, an electronic calculator, a word processor, a workstation, a video telephone, a POS (Point of Sale System) terminal, a printer, a scanner, a copier, a video player, an apparatus including a touch panel, and the like.

Figure 10:
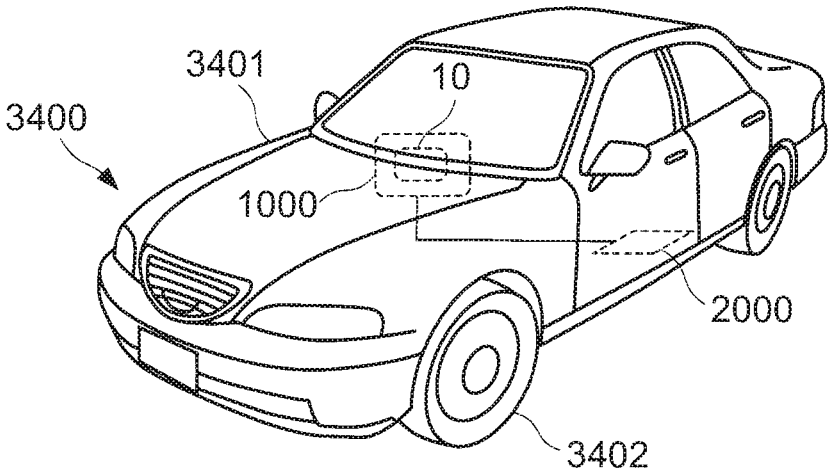
FIG. 10 is a schematic diagram of a movable body that is an example application.

FIG. 10 illustrates an exemplary configuration of a movable body to which the electro-optical device 1 has been applied. The movable body is an apparatus or a device that includes a drive mechanism such as an engine or a motor, a steering mechanism such as a steering wheel or a rudder, and various electronic apparatuses, for example, and moves over the ground, through the air, and on the sea. A car, an airplane, a motorcycle, a ship, a robot, or the like can be envisioned as the movable body. FIG. 10 schematically illustrates an automobile 3400 serving as a specific example of the movable body. The automobile 3400 includes a car body 3401 and wheels 3402. The electro-optical panel 10, the drive circuit 1000, and the external device 2000 that controls the units of the automobile 3400 are incorporated in the automobile 3400. The external device 2000 can include an ECU (Electronic Control Unit) or the like. The electro-optical panel 10 is a panel apparatus such as a meter panel. The external device 2000 generates an image to be presented to a user, and transmits the image to the drive circuit 1000. The drive circuit 1000 displays the received image on the electro-optical panel 10. For example, information such as speed, remaining fuel, distance traveled, and settings of various devices are displayed as an image.

What is claimed is:

1. A drive circuit that drives an electro-optical panel, comprising:

an input terminal and an output terminal configured to be coupled to an external device;

a drive signal generation circuit configured to use a synchronizing signal that is input from the external device via the input terminal to generate a drive signal that drives the electro-optical panel;

a state signal generation circuit configured to generate a state signal indicating an operating state of the drive signal generation circuit;

a return signal generation circuit configured to generate a return signal obtained by superimposing the state signal on the synchronizing signal; and an output circuit configured to output the return signal from the output terminal to the external device.

2. The drive circuit according to claim 1, wherein the return signal generation circuit superimposes the state signal to generate the return signal in a period after a predetermined period of time had elapsed from a pulse of the synchronizing signal.

3. The drive circuit according to claim 1, wherein the operating state includes a normal state indicating normal operation, and an abnormal state indicating abnormal operation, and the state signal indicates a content of an abnormality in the abnormal state.

4. The drive circuit according to claim 3, wherein the drive signal generation circuit is supplied with image data indicating an image to be displayed on the electro-optical panel, a power source voltage, and a control signal that is used to generate the drive signal, and the content of the abnormality includes at least one of a transmission error in the image data, an abnormality in the power source voltage, and an abnormality in the control signal.

5. The drive circuit according to claim 1, wherein the drive signal generation circuit is supplied with image data indicating an image to be displayed on the electro-optical panel, and with a control signal that is used to generate the drive signal, and the external device is a host device configured to generate the image data, or is a control device configured to generate the control signal.

6. The drive circuit according to claim 1, wherein the electro-optical panel includes a first scanning line and a second scanning line, the drive signal generation circuit includes a scanning line drive circuit configured to drive the first scanning line and the second scanning line, and the synchronizing signal is a vertical start pulse signal of which one is transmitted to the scanning line drive circuit in one vertical scan.

7. The drive circuit according to claim 1, wherein the electro-optical panel includes a first data line and a second data line, the drive signal generation circuit includes a data line drive circuit configured to drive the first data line and second data line, and the synchronizing signal is a horizontal start pulse signal of which one is transmitted to the data line drive circuit in one horizontal scan.

8. An electro-optical device comprising:

the drive circuit according to claim 1, and an electro-optical panel configured to be driven based on the drive signal.

9. An electronic apparatus comprising the electro-optical device according to claim 8.

10. A movable body comprising the electronic apparatus according to claim 9.

* * * * *